United States Patent [19]

Filip

[11] 4,038,506

[45] July 26, 1977

[54] OIL PRESSURE SWITCH HAVING IMPROVED DIAPHRAGM SEAL

[75] Inventor: Stanislaw F. Filip, Don Mills, Canada

[73] Assignee: I.C.S. Ignition Control Systems Ltd., Montreal, Canada

[21] Appl. No.: 596,845

[22] Filed: July 17, 1975

[51] Int. Cl.[2] ..... H01H 35/34

[52] U.S. Cl. ..... 200/83 J; 200/83 N; 200/83 B; 92/98 R

[58] Field of Search ..... 73/262, 269, 406, 407 R; 340/242; 92/98 R, 99, 110; 200/83 R, 83 N, 83 P, 83 B, 83 J, 83 W, 302

[56] References Cited

U.S. PATENT DOCUMENTS

| | | | |
|---|---|---|---|
| 2,421,797 | 6/1947 | Malone | 200/83 J |
| 2,822,530 | 2/1958 | Roten | 200/83 N |
| 2,837,611 | 6/1958 | Detwiler | 200/83 J |
| 2,885,860 | 5/1959 | Ray | 200/83 P |
| 3,054,871 | 9/1962 | Skay | 200/83 B |
| 3,093,716 | 6/1963 | Horowitz | 200/83 N |
| 3,109,908 | 11/1963 | Clason | 200/83 J |
| 3,188,867 | 6/1965 | Freismuth | 92/98 R |
| 3,432,633 | 3/1969 | Scherb | 200/83 J |
| 3,553,402 | 1/1971 | Hire | 200/83 P |

FOREIGN PATENT DOCUMENTS

| | | | |
|---|---|---|---|
| 1,386,750 | 1965 | France | 200/83 P |

*Primary Examiner*—Gerald P. Tolin
*Attorney, Agent, or Firm*—Finnegan, Henderson, Farabow & Garrett

[57] ABSTRACT

An oil pressure switch comprising a housing having an inlet end connectable to an oil pressure line to admit oil from the line within the housing. A flexible membrane is secured in the housing and having opposed surfaces. One of these opposed surfaces is in contact with the oil admitted to the housing while the other of the surfaces is in engagement with a spring biased electrical contact. The spring biased electrical contact is in abutting engagement with a stationary electrical contact. Connection means is provided for each of the electrical contacts. The membrane is displaced by pressure in the oil line whereby the spring biased contact is caused to be displaced against its spring biased direction to cause disengagement with the stationary electrical contact.

3 Claims, 2 Drawing Figures

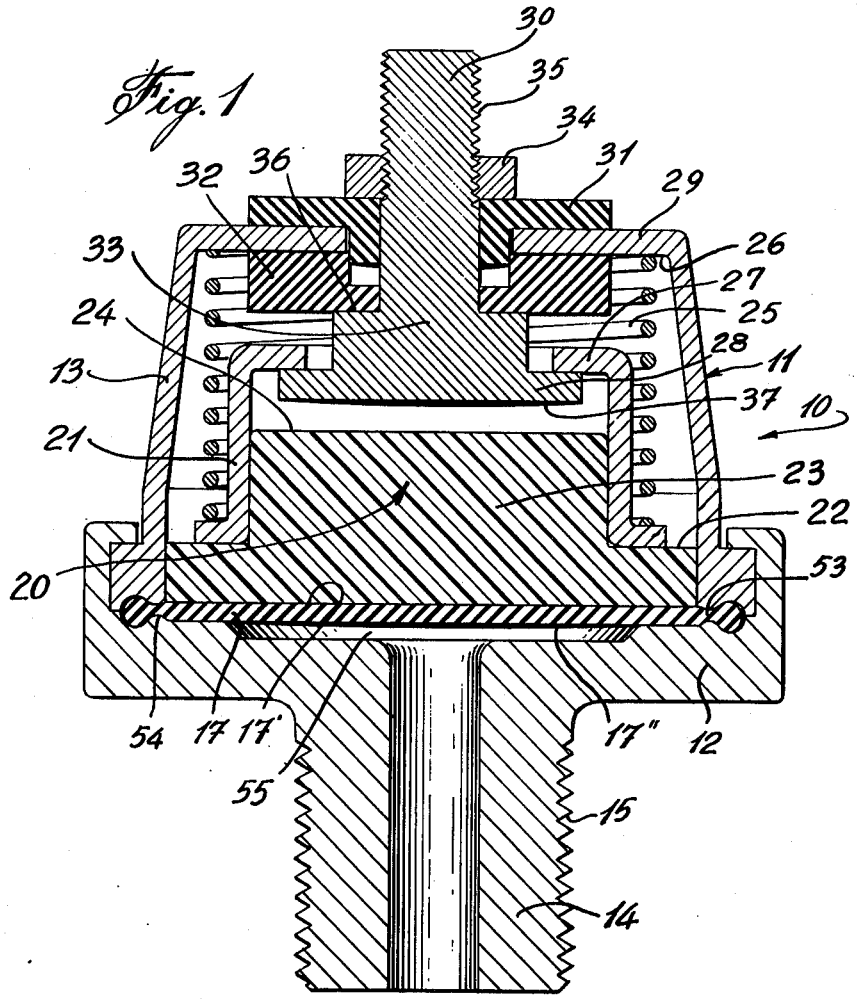
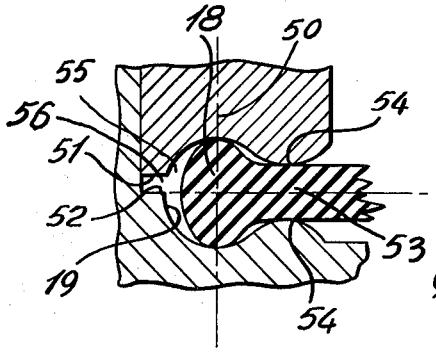
Fig. 2

OIL PRESSURE SWITCH HAVING IMPROVED DIAPHRAGM SEAL

BACKGROUND OF INVENTION a. Field of the Invention

The present invention relates to an improved oil pressure switch to indicate the presence or absence of proper pressure in an oil pressure line.

b. Description of Prior Art

In known oil pressure switches of the type described herein there exists a problem that these switches have not been found adequate as they develop leakage of oil which is being sensed thereby in a oil pressure system. Heretofore, a proper seal has not been devised for the proper engagement of the parts of the switch housing or in the area of engagement of a flexible membrane normally used in such switches whereby to cause detection of oil pressure by displacement of the membrane.

SUMMARY OF INVENTION

It is a feature of the present invention to provide an oil pressure switch which substantially overcomes all of the above mentioned disadvantages.

It is a further feature of the present invention to provide an oil pressure switch having an improved flexible membrane therein.

According to the above features, from a broad aspect, the present invention provides an oil pressure switch comprising a housing having an inlet end connectable to an oil pressure line to admit from the line within the housing. A flexible membrane is secured in the housing and having opposed surfaces. One of these opposed surfaces is in contact with the oil admitted to the housing whilst the other of the surfaces is in engagement with a spring biased electrical contact. The spring biased electrical contact is in abutting engagement with a stationary electrical contact. Connection means is provided for each of the electrical contacts. The membrane is displaced by pressure in the oil ine whereby the spring biased contact is caused to be displaced against its spring biased direction to cause disengagement with the stationary electrical contact.

BRIEF DESCRIPTION OF DRAWINGS

A preferred embodiment of the present invention will now be described with reference to the accompanying drawings in which:

FIG. 1 is a sectional side view of the oil pressure switch of the present invention; and FIG. 2 is a sectional fragmented view showing the location of the ridge of the membrane in a cavity before engagement of the membrane by the cavity.

DESCRIPTION OF PREFERRED EMBODIMENTS

Referring now to the drawings there is shown generally at 10, the oil pressure switch of the present invention. The switch 10 is provied with a housing 11 which is constituted by a base section 12 and a cap section 13. An inlet end 14 is provided in the base section 12 and is connectable by means such as threads 15, to an oil pressure line (not shown) whereby to admit oil from the line within the housing 11 via a passage 16 provided in the inlet end 14.

A flexible membrane 17 hereinshown has a flat member of flexible impervious material, such as rubbe is secured within the housing 11. The membrane 17 is of substantially circular configuration and is provided with a peripheral ridge 18 extending above opposed surfaces 17' and 17'' of the membrane 17. As shown in FIG. 1 the ridge 18 is clamped in a continuous cavity 19 which is of larger cross-sectional area than the cross-sectional area of the ridge 18. The construction of the cavity 19 and its securement of the ridge therein will be described in detail hereinbelow.

The membrane 17 has opposed surfaces 17' and 17'' with the surface 17'' being in contact with oil admitted in a chamber 55 through the passage 16. The other surface 17' is in engagement with a support block 20 having a spring biased electrical contact 21 urged in guided engagement therewith. The support block 20 is of a circular configuration and provided with an annular flange 22 thereabout. The spring biased electrical contact 21 is of inverted cup-shape and provided with a bottom flange 23 which is engageable by the flange 22 of the support block 20. The contact 21 is prevented from lateral movement by means of a projection portion 23 formed with the block 20 extending within the contact 21.

The support block is also provided with an outer flat stop surface 24. A helical spring 25 is positioned between the flange 23 of the contact 21 and the top inner surface 26 of the cap section 13. Spring 25 urges the contact 21 downwardly in the direction of a support block. However, the contact 21 has limited displacement as it is provided with a top flange portion 27 which is in abutting engagement with a flange end 28 of a stationary contact 30 secured in the top wall 29 of the cap section 13.

The stationary contact 30 is secured in an insulating manner with the cap section 13 by means of two bushings 31 and 32 secured about a post section 33 of the stationary contact protruding through the top wall 29. This securement is achieved by means of a threaded nut 34 threaded over the uppermost section 35 of the post 33, thus clamping the insulating bushing 31 and 32 between the nut 34 and a shoulder portion 36 of the stationary contact. The bushings 31 and 32 are of insulating material and provide a seal about the stationary contact 30.

In a position shown in FIG. 1, the stationary contact 30 is in engagement with stationary contact 21. The cap section and base section of the housing 11 are both made of electrically conductive material and seeing that the spring 25 is in contact with the cap section 13 and the contact 21, there is an electrical flow path provided between the contact 21 and the housing 11. The housing is normally grounded whereby a closed circuit condition can be provided when both contacts 30 and 21 are in engagement.

As soon as pressure is applied to the oil in the pressure line (not shown), the membrane 17 will be displaced against the support block 20 pushing the spring biased electrical contact upwardly towards the stationary contact 30 and causing the flange sections 27 and 28 of the respective contacts to be disengaged. Thus, an "open" contact condition is established. The travel of the secondary contact 21 is restricted by the abutment of the outer stop face 24 with the flat contact surface 37 of the stationary contact 30. As soon as the oil pressure drops to a predetermined level which is below the pressure exerted by the spring 25 onto the secondary contact 27, the contact 27 will be displaced downwardly to engage with the stationary contact and thus cause a contact closure indicating that the oil pressure in the system is below the said predetermined level. This indication can be easily provided by the connecting lamp bulb, (not shown), or other type of visual or audible means between a battery and the stationary contact 30. When the contacts are in engagement the circuit is completed and the lamp bulb will be lit.

Referring to FIG. 2, it can be seen that the ridge 18 is substantially oval in cross-section with the long central axis 50 of the oval extending transversely of the planar axis of the flat membrane 17. The continuous cavity 19 is an annular cavity and is defined between opposed flat flange surfaces 51 and 52 provided in the cap section 13 and base section 12, respectively. When both surfaces 51 and 52 are brought into abutment the cavity 19 is of substantially circular cross section, in a major part thereof, and defines a clamping opening 53 which is of smaller width than the thickness of the major portion of the flat membrane 17 whereby the flat membrane adjacent the ridge 18 will be clamped or compressed in this area, as illustrated on the right side of FIG. 1. An arcuate ridge 54 is formed in each surface 51 and 52 on opposed sides of the opening 53 to provide clamping pressure.

FIG. 2 shows the disposition of the ridge 18 within the cavity 19 before the cavity is completely closed. When the cavity is closed, as shown in FIG. 1, pressure is applied from both sides of the oval ridge 18, along the long axis 50 thereof, thus compressing this ridge to conform substantially to the arcuate circular shape of the cavity 19. However, the cross-sectional area of the cavity 19 is made slightly larger than the cross-sectional area of the ridge 18 to maintain a gap 56 in said cavity. This gap facilitates the location of the ridge within the cavity 19.

The reason for the oval shape of the ridge 18 is that these switches are normally mounted in areas where it is subjected to heat variations, for example in the area of an internal combustion engine, thus causing the material of the switch to expand. This expansion will cause a slight separation of the walls 51 and 52 forming the cavity 19. However, because the ridge is compressed, the material will have a tendency to reassume its original oval shape and thus maintain tight frictional engagement with the inner wall of the cavity 19 preventing any leakage along this annular cavity.

In order for the membrane to be more sensitive to variations in oil pressure an oil admitting chamber 55 is provided in the base section 12 adjacent the surface 17" of the membrane.

The oil pressure switch of the present invention may have many applications. A common application is that used in an automotive vehicle and connected in the engine oil pressure line. When no pressure is applied to the oil, the contacts 21 and 30 are normally engaging making a closed circuit condition. An indicator lamp (not shown) normally mounted on the dashboard of the vehicle is connected to the stationary contact 30, on one side thereof, and to the battery on the other side. The housing of the switch 10 is normally connected to ground and the vehicle ignition switch is connected in this circuit. Thus, a closed circuit is formed and the light will be lit when the ignition key is in the "on" position. As soon as the engine is started pressure is applied to the oil causing separation of the contacts and the lamp to extinguish. If the oil pressure in the system drops below a predetermined level, which is calibrated with the pressure applied against the spring biased electrical contact 21 by the helical spring 25, then the contacts will engage again causing the dashboard lamp, (not shown) to be lit indicating to the operator a malfunction in the oil pressure system.

I claim:

1. An oil pressure switch comprising a housing having an inlet end connectable to an oil pressure line to admit oil from said line within said housing, a flexible membrane secured in said housing and having opposed surfaces, one of said surfaces being in contact with oil admitted to said housing, the other of said surfaces being in engagement with a displaceable member supporting a spring biased electrical contact, said spring biased contact being in abutting engagement with a stationary electrical contact, external connection means for said stationary electrical contact, said membrane being displaced by oil pressure in an oil pressure line connected to said inlet end whereby said spring biased contact is caused to be displaced against its spring biased direction to cause disengagement with said stationary electrical contact, said flexible membrane being a flat member of flexible impervious material having a peripheral ridge of larger thickness than the major portion of said flat member, said ridge being clamped in a continuous cavity which is of larger cross-sectional area than the cross-section of said ridge, said ridge being oval in cross-section with the long central axis of said oval extending transversely of the planar axis of said flat member, said continuous cavity being defined between opposed surfaces of two displaceable wall sections of said housing, said cavity having a substantially circular cross-section clamping portion with a narrow throat opening on an inner side thereof, said narrow throat opening being of smaller width than the thickness of said major portion of said flat member whereby said flat member adjacent said ridge will be maintained in compression along said narrow throat opening, said oval ridge being compressed in said continuous cavity from opposed sides in the direction of said long central axis, said housing being constituted by a base section and a cap section, said inlet end being provided in said base section, said continuous cavity being defined between opposed surfaces of said base and cap sections, said continuous cavity being located in an area of said housing about said inlet end to seal said inlet end from the inner area of said cap section which constitutes a switching chamber, both said electrical contacts being located at least partly in said chamber, a contact support block of non-conductive material being in engagement with said other of said surfaces of said membrane, said support block having an outer stop face, said stationary contact having a flanged end with a flat contact surface spaced from said outer stop face, said spring biased electrical contact being urged in guided engagement with said support block and having a flange wall in abutting engagement with said flanged end to limit said displacement of said spring biased electrical contact, said displacement of said membrane being limited by abutment of said outer stop face with said flat contact surface.

2. An oil pressure switch as claimed in claim 1 wherein said cap section and said base section are of conductive material, a helical spring of conductive material being disposed between an inner top wall of said cap section and said spring biased electrical contact whereby an electrical flow path is provided between said biased electrical contact and said housing, both said electrical contacts being insulated from one another when said membrane is displaced by said oil pressure.

3. An oil pressure switch as claimed in claim 1 wherein an arcuate ridge is provided on opposed sides of said opening, said continuous cavity being located in an area of said housing about said inlet end to seal said inlet end from a switching chamber of said housing; both said electrical contacts being located at least partly within said switching chamber.

* * * * *